US006639667B1

(12) United States Patent
Gilbert et al.

(10) Patent No.: US 6,639,667 B1
(45) **Date of Patent: *Oct. 28, 2003**

(54) METHOD AND APPARATUS FOR ANALYSIS OF CHEMICAL CONSTITUENTS IN AN ELECTROLYSIS CELL

(75) Inventors: Bernard Gilbert, Angleur (BE); Trygve Foosnæs, Årdalstangen (NO); Reidar Huglen, Vormedal (NO)

(73) Assignee: Norsk Hydro ASA, Oslo (NO)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/762,820

(22) PCT Filed: Aug. 11, 1999

(86) PCT No.: PCT/NO99/00250

§ 371 (c)(1),
(2), (4) Date: Jul. 18, 2001

(87) PCT Pub. No.: WO00/09783

PCT Pub. Date: Feb. 24, 2000

(30) Foreign Application Priority Data

Aug. 14, 1998 (NO) ..... 19983730

(51) Int. Cl.[7] ..... G01J 3/44
(52) U.S. Cl. ..... 356/301; 250/339.07; 205/372
(58) Field of Search ..... 356/301; 250/339.07, 250/339.08, 339.12, 372

(56) References Cited

U.S. PATENT DOCUMENTS 4,802,761 A * 2/1989 Bowen ..... 356/301
5,412,465 A * 5/1995 Baylor ..... 356/301
5,822,072 A * 10/1998 Dai ..... 356/436

OTHER PUBLICATIONS

B. Gilbert, et al., "Reivestigation of molten fluoroaluminate Raman spectra: the question of the existence of AIF5 ions", Applied Spectroscopy, 44(2), 1990, pp. 299–304.*
Applied Spectroscopy, vol. 44, No. 2, 1990, B. Gilbert et al., "Reinvestigation of Molten Fluoroaluminate Raman Spectra: The Question of the Existence of A1F 5 2—Ions" pp. 299–304.

* cited by examiner

*Primary Examiner*—John Juba
*Assistant Examiner*—Leo Boutsikaris
(74) *Attorney, Agent, or Firm*—Wenderoth, Lind & Ponack, L.L.P.

(57) ABSTRACT

Method for determining chemical constituents in an electrolysis cell for the production of metal, in particular aluminum, involving the use of light spectroscopy such as Raman spectroscopy that analyses the light emitted from the cell constituents and represents the light as a spectrum, wherein the analysis is performed directly in the cell while the cell is in its production mode, whereby the spectrum is analysed on the basis of reference spectrums based on known compositions, to determine chemical constituents in the cell. Also provided is an apparatus for performing this method.

16 Claims, 4 Drawing Sheets

Table 1

Figure 1:
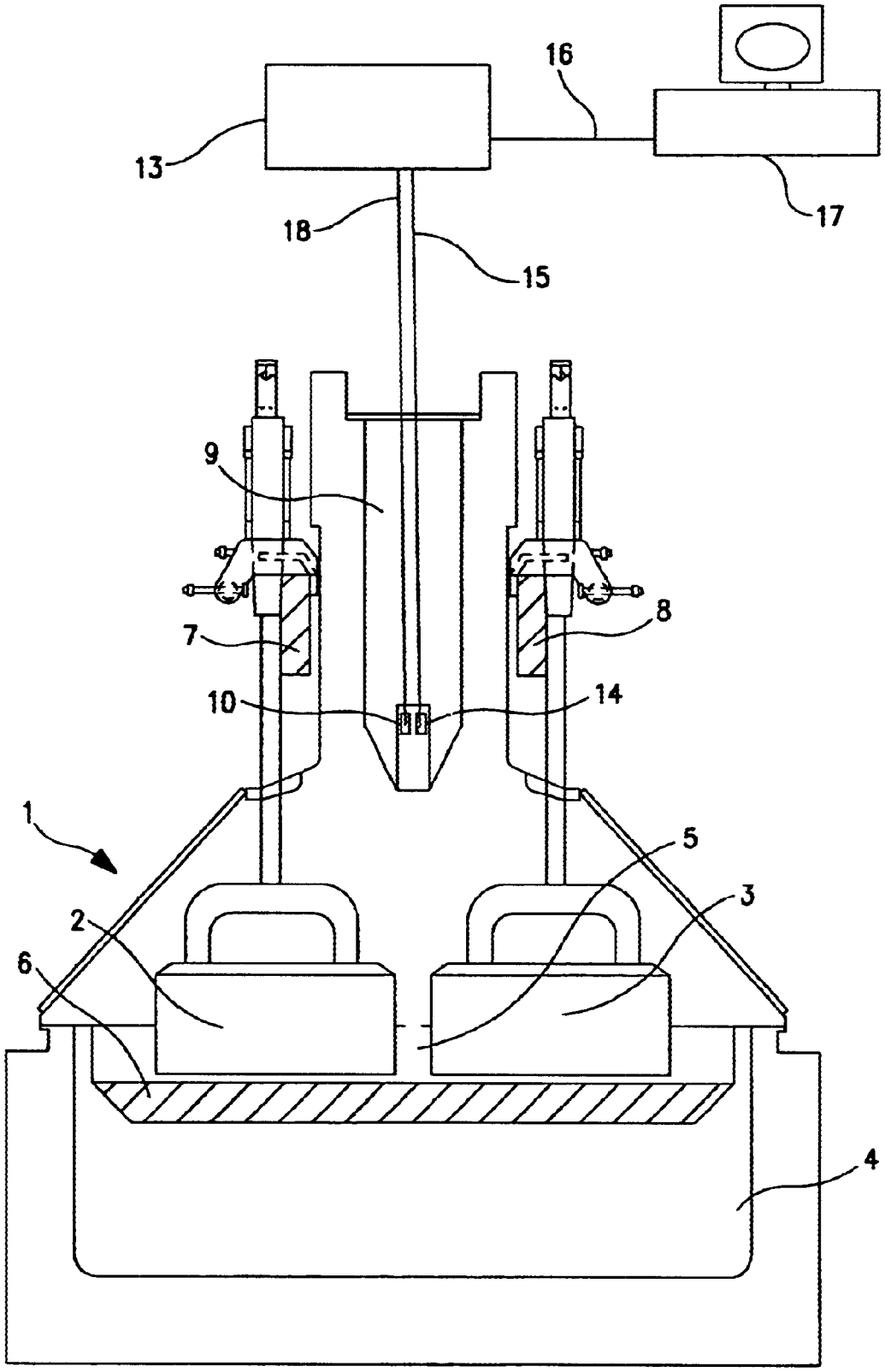

| CR=2.4 | CR=2.8 | CR=3.0 |
|---|---|---|
| 0% | 0% | 0% |
| 1% | 1% | 0.9% |
| 2.4% | 1.9% | 2.0% |
| 3.1% | 2.8% | 3.9% |
| 6.0% | 5.8% | 6.0% |

FIG. 2

Table 2

| SAMPLES | Approximate Alumina content (weight %) | Mass Excess of $AlF_3$(%) (calculated manually) | Mass Excess of $AlF_3$(%) (calculated automatically) | Mass Excess of $AlF_3$(%) (given) |
|---|---|---|---|---|
| C07 | 0.8±0.3 | 8.1 | 9.5 | 9.2 |
| C08 | 0.9±0.3 | 11.74 | 11.4 | 10.5 |
| C26 | 1.2±0.3 | 11.2 | 13 | 10.7 |
| C27 | 0.9±0.3 | 12.7 | 13.45 | 12.1 |
| C59 | 1.7±0.3 | −2.6 | 1.1 | −2.6 |
| C75 | 1.5±0.3 | 11.9 | 11.8 | 12.8 |
| C83 | 0.6±0.3 | 5.2 | 5.05 | 4.6 |
| C89 | 0.9±0.3 | 11.4 | 12.25 | 12.2 |
| C94 | 1.6±0.3 | 10.5 | 11.8 | 9.2 |
| C101 | 0.7±0.3 | 12.3 | 12.9 | 11.9 |
| C102 | 0.7±0.3 | 1.1 | 3.7 | 1.7 |
| D09 | 0.9±0.3 | 10.9 | 13 | 12.3 |
| D28 | 0.7±0.3 | 11.8 | 13 | 11.6 |
| D34 | 2.2±0.3 | 12.7 | 14 | 11.4 |
| D45 | 1.1±0.3 | 12.9 | 14 | 16.4 |
| D51 | 1.5±0.3 | 7.1 | 10.4 | 12.6 |
| D61 | 0.6±0.3 | 7.4 | 9.5 | 8 3 |
| D78 | 0.6±0.3 | 7.4 | 9.9 | 9 9 |
| D95 | 1.2±0.3 | 12.7 | 14.2 | 12 5 |
| D96 | 1.0±0.3 | 14.6 | 14.1 | 14.2 |

FIG. 3

Table 3

A) Previous results(obtained manually)

| Sample | CR | mass excess of $AlF_3$(%) | LEICO oxide content (weight %) | RAYLEIGH alumina content (weight %) |
|---|---|---|---|---|
| 2004 | 2.15 | 13.6 | 3.8 | 3.3±0.4 |
| 2005 | 2.30 | 10.8 | 3.8 | 2.9±0.4 |
| 2006 | 2.15 | 13.6 | 5.3 | 4.0±0.5 |
| 2007 | 2.20 | 12.7 | 3.7 | 3.1±0.4 |

B) Results from automatic analyses

| Sample | CR | mass excess of $AlF_3$(%) | RAYLEIGH alumina content (weight %) |
|---|---|---|---|
| 2004 | 2.185 | 12.97 | 3.2 |
| 2005 | 2.27 | 11.30 | 2.9 |
| 2006 | 2.21 | 12.53 | 3.6 |
| 2007 | 2.24 | 11.97 | 3.0 |

FIG. 4

METHOD AND APPARATUS FOR ANALYSIS OF CHEMICAL CONSTITUENTS IN AN ELECTROLYSIS CELL

This application is a 371 application of PCT/NO99/00250 filed Aug. 11, 1999.

The present invention relates to a method and an apparatus for the analysis of chemical constituents in an electrolysis cell for production of metal. In particular, the invention relates to continuous analysis of the oxide concentration and the cryolite ratio in electrolysis cells for production of aluminum working in accordance with the Hall-Héroult process.

In the Hall-Héroult process, aluminum is produced by electrolytic reduction of alumina ($Al_2O_3$) dissolved in a bath based on molten cryolite ($Na_3AlF_6$). The metal is formed at the molten aluminum cathode, and oxygen is discharged at the carbon anode. Increasing knowledge of the processes involved, has enabled modifications to be made on the bath compositions. Some fluorides in small and limited amounts are added to the bath in order to lower the bath temperature, and increase the efficiency of the electrolytic process. Aluminum fluoride ($AlF_3$) is the most common additive, and commonly cells are operated with an excess aluminum fluoride content relative to cryolite. In addition, the bath may contain a certain amount of calcium fluoride ($CaF_2$), which mainly originates from the calcium oxide (CaO) impurity in the alumina feed. In some cases, calcium fluoride is voluntary added to the bath as well.

To operate the cells in a manner that is effective with respect to several criteria such as dissolution of alumina, energy consumption, current. efficiency, sludge formation, compensation of additives as a result of evaporation losses and losses when draining metal, environmental regulations, etc., it is of great importance that parameters such as the cryolite ratio CR (the molar ratio of NaF and $AlF_3$), bath ratio (the mass ratio of NaF and $AlF_3$), excess $AlF_3$ (the mass % $AlF_3$ in excess of the $Na_3AlF_6$ composition) and the A oxide concentration can be determined in a precise and continuous manner.

Up to present, numerous suggestions have been made as to possible structural species in cryolite-alumina melts as such. In this work, Raman spectroscopic measurements have been performed to analyse the bath composition. Such measurements are based upon the fact that the different species emit light at a characteristic wavelength, and the technique is commonly used to indicate the presence of different species in laboratory work. One example of such work performed is published in the paper: "Reinvestigation of Molten Fluoraluminate Raman Spectra: The Question of the Existence of $AlF_5^{2-}$ Ions, B. Gilbert and T. Materne, Applied Spectroscopy, Volume 44, Number 2, 1990". In addition, the paper discloses a laboratory equipment for spectroscopic analysis of melt samples.

Further, one commonly used method for indicating the alumina concentration in an electrolysis cell is based upon. cell voltage measurements related to the electrical conductivity of the electrolyte. Other methods involve taking samples of the bath for the analysis of the composition in a laboratory.

However, present methods are either not very precise or not continuous and need further evaluation to fit the steadily increasing demands, of the electrolysers for optimising their processes.

In accordance with the present invention, it is now possible to determine both the alumina (oxide) concentration and the cryolite ratio in a precise and continuous manner. in an electrolysis cell under its production of metal. The invention involves the use of Raman spectroscopy where spectrums of light emitted from the melt/bath are compared to reference spectrums generated from samples of known compositions. This "fingerprint" recognition. method has proved to be very accurate, and the apparatus together with the proposed method make it possible to perform the analysis in an continuous manner.

The invention will in the following be described by examples and figures where:

FIG. 1 shows an apparatus according to the present invention, arranged in an electrolysis cell of the Hall-Héroult type, FIG. 2 shows Table 1 which is for a composition of recorded samples, FIG. 3 shows Table 2 which is for a comparison between two methods for analysis, and FIG. 4 shows Table 3 which is for a composition of samples of internal codes.

FIG. 1 shows a conventional electrolysis cell 1 with prebaked anodes 2, 3, cathode block 4, melted electrolyte or bath 5, and a metal pad of melted aluminum metal 6. The anodes 2, 3 are supported by busbars 7, 8, and a superstructure 9 is arranged in the upper region of the cell.

The invention is based upon a non contact system where the bath 5 in a producing electrolysis cell 1 is excited by a, high intensity light beam such as a laser beam led through an emitting device 10. The response signals of the species in the bath are collected and transported to a recording system comprising basically two main components such as an optical probe 14 and a spectrometer 13. Thus, solely an optical contact is provided between the emitting device 10 and the bath 5, and similarly solely optical contact is provided between the bath 5 and the recording system. By this provision it is possible to analyse by spectroscopy highly corrosive melts at a high temperature.

In one embodiment (not shown), the apparatus may comprise laser light (laser beam) that passes through a lens which focuses the light at a point remotely from the lens, i.e. in the melt. The response signal, i.e. backscattered light from the species in the melt, is picked up by the lens in a confocal manner or by an suitable. optical probe and is thereafter directed to the recording system comprising a spectrometer.

As seen in FIG. 1, the spectrometer 13 may have a distant location with respect to the optical probe 14, the response signal may then be transmitted from the optical probe 14 to the spectrometer 13 for instance by means of an optical fibre 15. In dependency of the energy in the laser light and the losses of the signal in the transmitting system, the laser and the optical probe may be located at a distance well above the bath 5, e.g. in the upper structure 9 of the electrolysis cell 1. In this embodiment the laser exciting, source may be located (not shown) in the box of the spectrometer 13 and connected with the emitting device 10 by an optical fibre 18.

The fact that the measurements are based on a non-contact principle at a distance above the bath makes it possible to operate the involved equipment in a safe manner, as said distance provides a protective buffer for the hardware with respect to the high temperatures and the corrosive chemicals involved.

The output signal 16 from the spectrometer 13 is prepared by a computer 17 set up with a computer programme that makes a graphic representation of the signal. The graphic representation can be denoted as a "production spectrum". In the computer, the production spectrum is compared with information recorded from known melt compositions, denoted in the following as "reference spectrum". The reference spectrums are stored in a database accessible by the computer, and may for instance be established by laboratory investigations. The laboratory, investigations may involve analysis of samples in a windowless crucible by 90° measurements (angle of laser beam versus scattered light). Such equipment and recording techniques are known as such by those skilled in the art, and will therefore not be further described here.

Reference Spectra $Al_2O_3$—$CaF_2$—NaF—$AlF_3$

Various samples have been recorded based upon mixtures of $Al_2O_3$—$CaF_2$—NaF—$AlF_3$. In the example, mixtures with CR=2.4, 2.8, 3.0 (corresponding to 9.09, 2.78 and 0 mass excess of $AlF_3$) and with 0 to 6 weight % of $Al_2O_3$ have been recorded. For each sample, the amount of $CaF_2$ used was set to 5 weight % to match the usual $CaF_2$ content of an industrial bath. The present recorded samples compositions are presented in Table 1.

By using what here is called the "RAYLEIGH method" correlation coefficients of calibration curves are calculated. These results are given below:

| Composition (CR) | 2.4 | 2.8 | 3.0 |
|---|---|---|---|
| Corr. Coefficient | 0.999 | 0.997 | 0.999 |

The obtained correlations are very good, and it seems that the correlation is better in presence of $CaF_2$, which means that its presence tends to stabilise the Rayleigh decay.

Development of an Automatic Analysis Procedure

In order to measure precisely the composition of any industrial bath, the first parameter to be determined in accordance with the present method is the $Al_2O_3$ content. When this parameter is determined, the contribution of $Al_2O_3$ may be subtracted from the initial production spectra and then it is possible to accurately measure the requested excess of $AlF_3$.

It is experienced that the RAYLEIGH method is the best method to obtain calibration curves for the alumina content in $Al_2O_3$—NaF—$AlF_3$ mixtures. Combined with the generation of reference spectrum, the oxide content can be evaluated and thus the true final acidity of a mixture. A software program has been developed to be able to extract the oxide content and the mass excess of $AlF_3$ directly from a raw spectrum, and has proved to be very user friendly.

By collecting and analysing a lot of NaF—$AlF_3$ mixtures spectra recorded at about the same temperature, it was found that the ratios of the 560 $cm^{-1}$ band intensity over the one at 622 $cm^{-1}$ vary regularly with the Cryolitic Ratio or the $AlF_3$ mass excess. Based on this finding, it was suggested to approximate an initial acidity of a sample by simply measuring the relative intensities of both bands and deducing the composition from the polynomial fits of previous datas. The method was incorporated in a software program and it turns out that this technique is extremely fast while it seems to give very good results.

Knowing an initial value of the melt composition, the program chooses the closest (in melt composition) experimental reference spectrum (made of NaF—$AlF_3$ for instance by laboratory analysis). By comparing the intensities of both spectra in the range of 60 to 100 $cm^{-1}$ and at 300 $cm^{-1}$, and applying automatically procedures for processing the spectrum (scaling etc.), the program can fit the unknown production spectrum to the reference one. It then calculates the oxide content by determining the intensities at 180 $cm^{-1}$ for the reference spectrum and for the unknown production spectrum, and by using a predetermined average slope. The overall technique is very fast: the result is obtained in less than two seconds. The application of the automatic technique to real samples is presented below.

Because the Al—O bands overlap somewhat with the Al—F bands near 600 $cm^{-1}$, the ratio of the 560 $cm^{-1}$ band intensity over the one at 622 $cm^{-1}$, measured on the unknown, is partially incorrect. It can be corrected by subtracting an Al—O spectrum with a scale factor depending on the Al—O content found in the initial step.

The evaluation of the reference spectrum intensity at 180 $cm^{-1}$ is critical to obtain a reliable oxide content value. Because the actual program chooses as reference spectrum the one exhibiting the closest NaF—$CaF_2$—$AlF_3$ composition, which may eventually be somewhat different from the initial one, a procedure allowing to standardise reference spectra for any composition have been developed.

Analysis of Industrial Samples

Various samples (samples of internal codes: C07, C08, C26, C27, C59, C75, C83, C89, C94, C101, C102, D09, D28, D34, D45, D51, D61, D78, D95, D96) have been by both a manual and an automatic method. The manual procedure was as follows:

Step one is to compare visually on the computer screen the unknown sample spectrum with various NaF—$AlF_3$ spectra and choose the closest reference spectrum which matches the band profile in the 560 to 650 $cm^{-1}$ range. In step two the oxide content is calculated using this reference and the RAYLEIGH method. The oxide contribution is then removed by subtracting an oxide spectrum (with a scaling factor) obtained by comparing NaF—$AlF_3$ and $Al_2O_3$—NaF—$AlF_3$ mixtures spectra.

The resulting spectrum is flattened and the 350 $cm^{-1}$ band is removed in order to isolate the 450–650 $cm^{-1}$ range of the spectrum. Then synthetic spectra of known CR (cryolite ratio) is generated and a comparison is made between them and the resulting spectrum of the sample until a precisely match is obtained.

The automatic procedure involves recalling the spectrum to be analysed and pressing one key; the resulting calculated compositions, i.e. the oxide content and the acidity of the mixture, are immediately proposed by the computer.

The results of the analysis are summarised in table 2.

Considering the mass excess of $AlF_3$, one can see that both methods (manual and automatic) give very acceptable results compared. with the known compositions of samples of internal codes 2004, 2005, 2006 and 2007, see table 3.

It should be understood that the principles described above can advantageously be adopted to most kinds of metal producing cells working according to thermal reduction principles.

What is claimed is:

1. A method for determining chemical constituents of a bath in an electrolysis cell for production of metal, involving the use of Raman spectroscopy that analyses light emitted from the cell constituents and represents the light as a production spectrum, which comprises performing the analysis directly in the cell while the cell is in its production mode, analysing the production spectrum for comparison of the production spectrum with stored reference spectrums recorded of known compositions to retrieve the closest reference spectrum which matches the band profile in a range of 560 to 650 $cm^{-1}$, and determining the presence and amount of chemical constituents in the bath on the basis of the reference spectrum, wherein the chemical constituents in the bath which are determined include at least oxide concentration and/or cryolite ratio.

2. The method according to claim 1, wherein the metal is aluminum.

3. The method according to claim 1, wherein the production spectrum is analysed with the assistance of a computer.

4. The method in accordance with claim 3, wherein the computer is equipped with software that performs an iterative process where the production spectrum is compared with the stored reference spectrums to produce an output describing the presence and amount of recognised constituents.

5. The method in accordance with claim 2, wherein the bath in the cell is analysed to determine the amount of alumina ($Al_2O_3$) and mass excess of $AlF_3$.

6. The method in accordance with claim 1, wherein the analysis is performed in a continuous manner.

7. The method in accordance with claim 1, wherein the analysis is performed by recording emitted light substantially perpendicular to a surface of the bath.

8. The method according to claim 1, wherein measurements taken for the analysis are based on a non-contact principle at a distance above the bath.

9. The method according to claim 3, wherein measurements taken for the analysis are based on a non-contact principle at a distance above the bath.

10. An apparatus for analysis of chemical constituents of a bath in an electrolysis cell for production of metal, involving the use of Raman spectroscopy that analyses light emitted from the cell constituents and represents the light emitted as a production spectrum, which apparatus comprises:

an optical probe connected to a spectrometer, wherein the probe is positioned to receive light emitted substantially perpendicular to a surface of the bath in the cell, the probe being located above the bath surface, and a computer connected with the spectrometer for analysing and comparing the production spectrum with stored reference spectrums recorded of known compositions to retrieve the closest reference spectrum which matches the band profile in a range of 560 to 650 $cm^{-1}$, whereby the presence and amount of chemical constituents in the bath can be determined on the basis of the reference spectrum, wherein the chemical constituents in the bath which are determined include at least oxide concentration and/or cryolite ratio.

11. The apparatus according to claim 10, wherein the metal is aluminum.

12. The apparatus according to claim 10, which further comprises an exciting system to excite the bath.

13. The apparatus according to claim 12, wherein the exciting system comprises a laser and an emitting device, and the emitting device and the optical probe are integrated in one unit to be fixed in a superstructure above the bath, or to be held by a person as a portable unit.

14. The apparatus according to claim 13, wherein the laser is a pulsed laser.

15. The apparatus according to claim 13, wherein the laser is a solid state laser.

16. The apparatus according to claim 10, wherein the optical probe is connected to the spectrometer by an optical fibre.

* * * * *